US008926365B2

(12) United States Patent
Schull et al.

(10) Patent No.: US 8,926,365 B2
(45) Date of Patent: Jan. 6, 2015

(54) ELECTRICAL CONNECTOR

(75) Inventors: Frederic Schull, Hagenbach (FR); Yannick Nurdin, Walheim (FR)

(73) Assignee: Multi-Holding AG, Allschwil (CH)

( * ) Notice: Subject to any disclaimer, the term of this patent is extended or adjusted under 35 U.S.C. 154(b) by 77 days.

(21) Appl. No.: 13/700,285

(22) PCT Filed: Jun. 1, 2011

(86) PCT No.: PCT/EP2011/059081

§ 371 (c)(1),
(2), (4) Date: Nov. 27, 2012

(87) PCT Pub. No.: WO2011/154302

PCT Pub. Date: Dec. 15, 2011

(65) Prior Publication Data

US 2013/0078857 A1 Mar. 28, 2013

(30) Foreign Application Priority Data

Jun. 11, 2010 (CH) ..... 0947/10

(51) Int. Cl.

| | |
|---|---|
| ***H01R 13/658*** | (2011.01) |
| ***H01R 13/514*** | (2006.01) |
| ***H01R 13/659*** | (2011.01) |
| ***H01R 13/6585*** | (2011.01) |
| ***H01R 13/627*** | (2006.01) |

(52) U.S. Cl.

CPC ..... *H01R 13/658* (2013.01); *H01R 13/514* (2013.01); *H01R 13/659* (2013.01); *H01R 13/6585* (2013.01); *H01R 13/6273* (2013.01)

USPC ..... 439/607.01

(58) Field of Classification Search

USPC ..... 439/607.01, 607.41; 333/182, 183, 184

See application file for complete search history.

(56) References Cited

U.S. PATENT DOCUMENTS

| | | | | |
|---|---|---|---|---|
| 4,187,481 | A * | 2/1980 | Boutros | 333/182 |
| 2006/0110978 | A1* | 5/2006 | Fan et al. | 439/607 |
| 2008/0220652 | A1* | 9/2008 | Tyler | 439/610 |
| 2013/0078857 | A1* | 3/2013 | Schull et al. | 439/607.01 |
| 2013/0090009 | A1* | 4/2013 | Zhao | 439/607.01 |

FOREIGN PATENT DOCUMENTS

| | | | |
|---|---|---|---|
| EP | 0 924 809 | A2 | 6/1999 |
| FR | 2 776 844 | A3 | 10/1999 |
| WO | 2005/053102 | A2 | 6/2005 |

OTHER PUBLICATIONS

International Search Report of PCT/EP2011/059081 dated Jul. 27, 2011.

* cited by examiner

*Primary Examiner* — Alexander Gilman

(74) *Attorney, Agent, or Firm* — Sughrue Mion, PLLC

(57) ABSTRACT

A connector assembly comprises a pin-side (1) with at least one pin-side housing (2) in which at least one pin-side connector (3) is arranged, wherein said pin-side housing (2) having a front section (20) extending along a front axis (M1) and a rear section (21) extending along a rear axis (M2); a plug-side (4) with at least one plug-side housing (5) in which at least one plug-side connector (6) is arranged, wherein said pin-side housing having a front section (50) extending along a front axis (M3) and a rear section (51) extending along a rear axis (M4), and wherein the front section (20) of the pin-side (1) is adapted to be connected with the front section (50) of the plug-side (4) in direction of said front axis (M1, M3), and several shielding elements (7) to provide an electromagnetic shielding. Said housings (2, 5) comprise an outer surface (22, 52) on which latching elements (23, 53) are arranged, wherein said latching elements (23, 53) are adapted to be received by latching elements (23, 53) of a neighboring housing (2, 5) in order to establish a mechanical connection between two neighboring housings (2, 5). Said shielding elements (7) comprise latching elements (73) which are adapted to be received by said latching elements (23, 53) of said housings (2, 5) in order to establish a mechanical connection between the shielding element (7) and the respective housing (2, 5).

13 Claims, 7 Drawing Sheets

ELECTRICAL CONNECTOR

CROSS REFERENCE TO RELATED APPLICATIONS

This application is a National Stage of International Application No. PCT/EP2011/059081 filed Jun. 1, 2011, claiming priority based on Swiss Patent Application No. 00947/10, filed Jun. 11, 2010, the contents of all of which are incorporated herein by reference in their entirety.

TECHNICAL FIELD

The present invention relates to connector assembly according to the preamble of claim 1.

PRIOR ART

There are a plethora of connectors known from prior art. Such connectors usually comprise a pin-side to be connected to a plug-side and may serve for various purposes such as providing an electrical contact or establishing a fluid-tight connection in a pneumatic or hydraulic pipe system.

There are for example electrical connectors which are used to link railway carriages together such that there is an electrical contact provided in order to supply electrical appliances such as light etc. with electrical energy.

Furthermore it is known from prior art that connectors may be arranged parallel to each other so that several connections are established with one single insertion operation. Such a connector assembly is for example known from US 2006/0110978.

However, connector systems known from prior art usually have the disadvantage that the shielding structure is very complicated and not very efficient in terms of electromagnetic shielding or in terms of a shielding against mechanical impacts. Namely the connection from electromagnetic shielding of the cable to be connected with the connectors as well as the connection between the shielding elements of the pin-side connector with the one of the plug-side connector are not solved in satisfactory manner.

SUMMARY OF THE INVENTION

It is an object to provide a connector assembly which can be arranged in a modular manner, whereby the shielding shall be improved.

Such an object is achieved by a connector assembly according to claim 1. Such a connector assembly comprises a pin-side with at least one pin-side housing in which at least one pin-side connector is arranged, wherein said pin-side housing having a front section extending along a front axis and a rear section extending along a rear axis, a plug-side with at least one plug-side housing in which at least one plug-side connector is arranged, wherein said pin-side housing having a front section extending along a front axis and a rear section extending along a rear axis, and wherein the front section of the pin-side is adapted to be connected with the front section of the plug-side in direction of said front axis, and several shielding elements to provide an electromagnetic shielding. The assembly thereby comprises a pin-side, a plug-side and a shielding. Said housings comprise an outer surface on which latching elements are arranged, wherein said latching elements are adapted to be received by latching elements of a neighbouring housing in order to establish a mechanical connection between two neighbouring housings. Said shielding elements comprise latching elements which are adapted to be received by said latching elements of said housings in order to establish a mechanical connection between the shielding element and the respective housing.

This structure allows building a contact assembly in a modular manner, wherein the shielding can be adapted to the structure of the housing.

Preferably said shielding element has substantially the same dimension as the housing as viewed in a direction perpendicular to said front axis and/or rear axis.

Preferably at least one of said shielding elements is in connection with the pin-side housing and at least one of said shielding elements is in connection with the plug-side housing, wherein said shielding elements comprise also a plug-side and a pin-side in order to establish a preferably electrically connection between the plug-side of the shielding element and the pin-side of the shielding element.

Preferably each of the shielding elements comprises a plug-side and a pin-side, so that the same element can be used in connection with the pin-side as well as with the plug-side.

Preferably said latching elements are oriented in direction of said front axis and/or said rear axis such that the housings are connectable with a movement in direction of said front axis and/or said rear axis with each other or with said shielding element. It is an advantage that the latching elements can be used to connect the housings with each other as well as said housing with the shielding element.

Preferably said housing as well as said shielding elements comprise a locking structure in order to secure neighbouring housing against a relative movement to each other and/or in order to secure said shielding elements against a relative movement to the respective housing. The locking structure comprises preferably a recess in the housing and/or recess in the shielding element which recesses provide a complete recess, if the respective elements are in connection with each other, and a pin which can be introduced in said complete recess.

Preferably said latching elements are arranged in the front section and in the rear section so that each of the housings comprises two latching elements which are separated from each other. With two separate latching elements a very firm connection can be provided.

The housings have substantially the shape of a hollow cylinder with a preferably circular cross section, wherein said hollow cylinder defines an interior space in which said connectors are arranged. The latching elements are preferably arranged on embossments which circumvent said hollow cylinder in manner that a prismatic cross-section result, wherein the surface of said prismatic cross-section provide said outer surface.

Preferably at least two groups of latching elements are arranged, whereby said two groups are arranged separately from each other at a distance and wherein between said groups said locking structure is arranged.

Preferably the front axis is arranged collinear with the rear axis.

Alternatively the front axis is arranged angular with the rear axis, wherein the angle between the front axis and the rear axis is preferably between 90° or 150°, in particular 90°: Thereby an angular connector may be provided.

Preferably the pin-side connector as well as the plug-side connector comprises a connector element extending along the front axis and a bridging element extending along the rear axis, wherein either the connector element or the bridging element comprise an opening in which the bridging element or the connector element, respectively extends such that an electrical contact is established between the connector element and the bridging element. With this structure a very compact angular connector can be provided.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
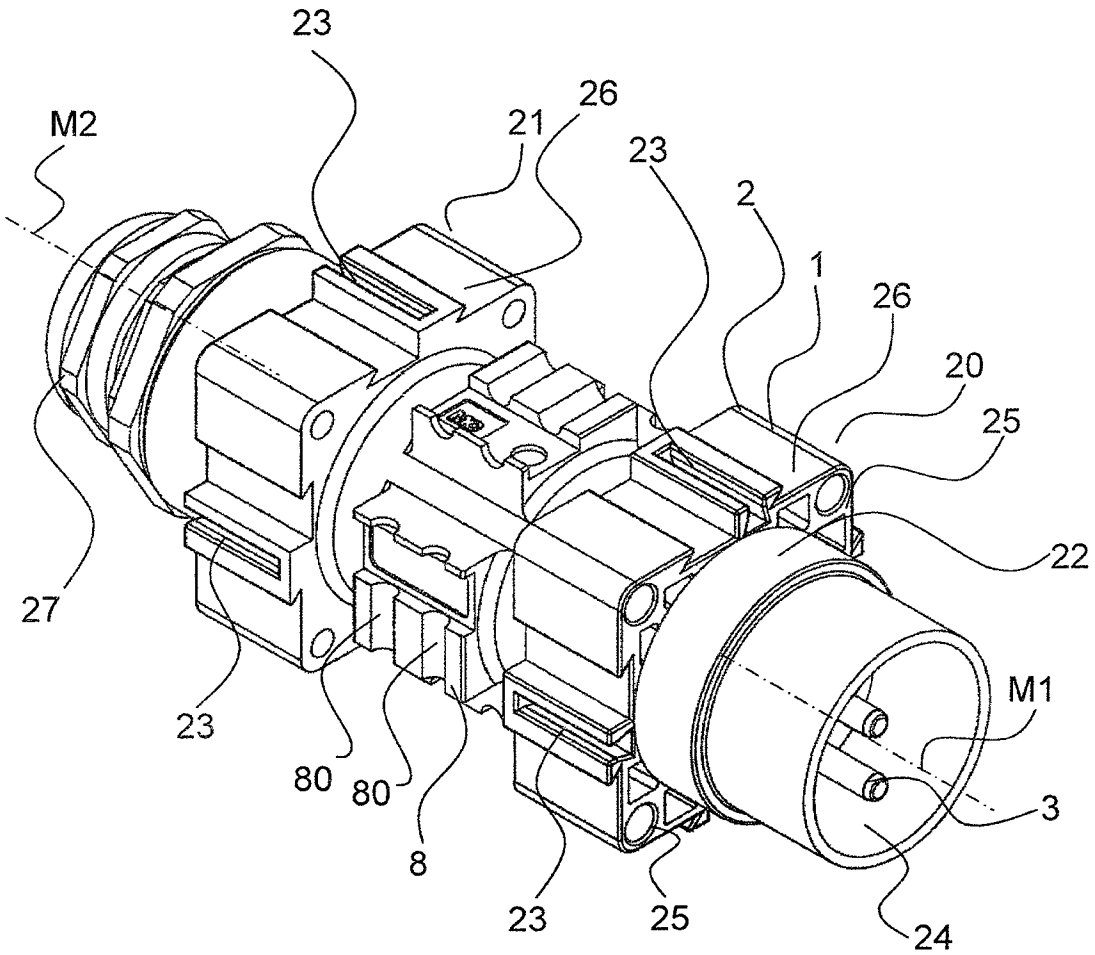
FIG. 1 shows a perspective view of pin-side of a connector assembly.

FIGS. 1 to 4 show a first embodiment of connector assembly. Such a connector assembly is provided to establish a contact between two energy carrier, such as electrical cables and/or hydraulic pipes and/or pneumatic pipes. Thereby the connector assembly serves as multi-polar connector with which several electrical cables to transmit electrical energy and/or control signals. Optionally the connector assembly may also include other energy carriers as mentioned above.

The connector assembly comprises a pin-side 1 with at least one pin-side housing 2 in which at least one pin-side connector 3 is arranged and a plug-side 4 with at least one plug-side housing 5 in which at least one plug-side connector 6 is arranged. Preferably several housings 2, 5 are arranged parallel to each other so that the pin-side 1 as well as the plug-side 2 comprises a multi-polar structure. The pin-side 1 and the plug-side 2 can be connected with each other in order to establish a contact between the pin-side connector 3 of the pin-side 1 and plug-side connector 6 of the plug-side 2.

The pin-side connector 3 and the plug-side connector 6 can be an electrically conductive element whereby a contact element 60, such as a contact lamella is arranged in order to establish an electrical contact between the pin-side connector 3 and the plug-side connector 6. In case a contact between other energy carriers shall be established, the connectors may also have the shape as pipe connection in order to establish a connection between the pipes. Depending on the application the connectors can be unipolar or can have several number of poles.

With regard to FIG. 1 the structure of the pin-side 1 will be explained in greater detail. The pin-side housing 2 comprises a front section 20 extending along a front axis M1 and a rear section 21 extending along a rear axis M2. The pin-side housing 2 has the shape of a hollow cylinder extending along the front axis M1 and the rear axis M2. The hollow cylinder has preferably a circular cross-section and defines an interior space 24 and an outer surface 22. The pin-side connector 3 is arranged within the interior space 24. On the outer surface 22 two embossments 25 are arranged at a distance between each other. The embossments 25 have a prismatic cross-section, preferably a quadratic cross-section. The embossments 25 provide attachment surfaces 26 to accommodate said latching elements 23. Alternatively, the latching elements 23 may also be arranged directly on the outer surface 22.

The latching elements 23 have preferably the shape of a dovetail joint. However, other shapes are also possible. With this regard it has to be mentioned that it is preferable that two neighbouring pin-side housing are contactable via movement in direction of one of the axis M1 or M2.

In case the pin-side connector 3 is an electrical connector, a cable is electrically connected to the pin-side connector 3 in the interior space 24.

The front section 20 of the pin-side housing 2 is adapted to engage with the front section 50 of the plug-side housing 5.

The rear section 21 comprises optionally a clamping element 27 with which a cable may be clamped in order to secure the cable against force in the axis of the cable.

Figure 2:
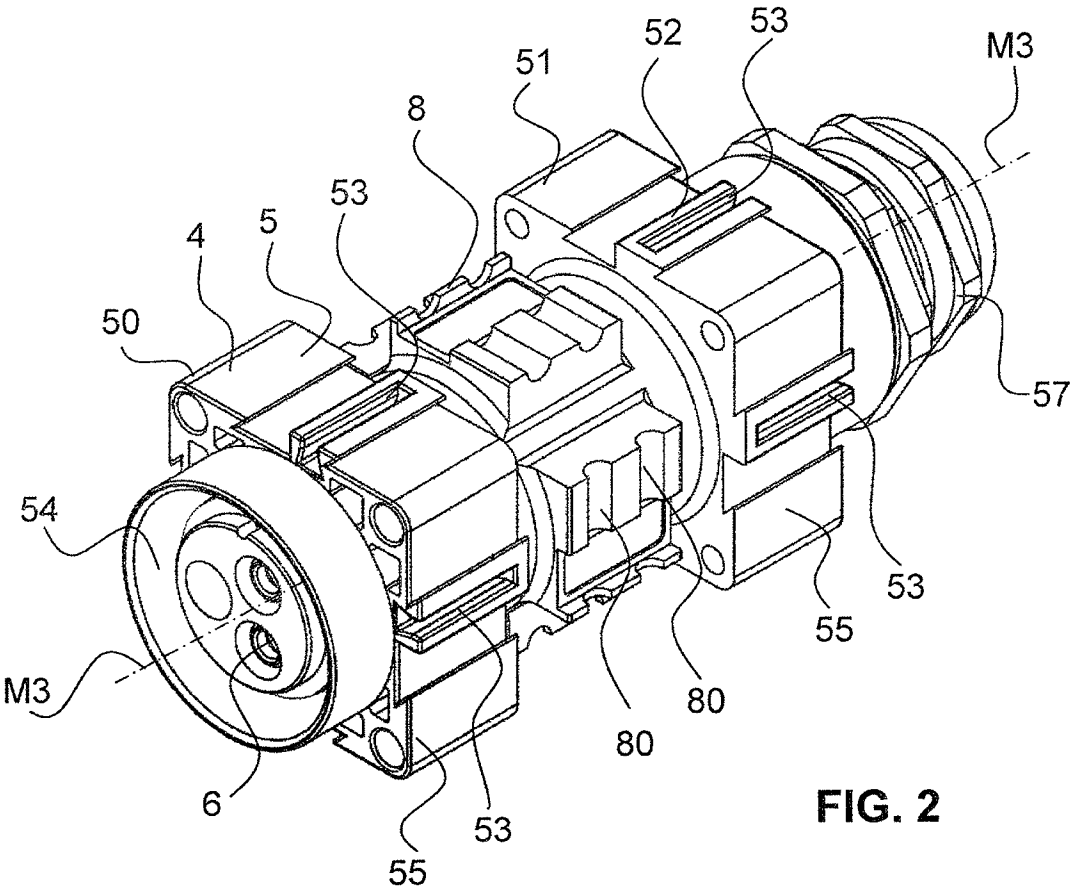
FIG. 2 shows a perspective view of plug-side of a connector assembly.

Reference is now made to FIG. 2 in which the plug-side 4 is shown. Apart from the plug-side connector 6 the plug-side housing 5 is substantially identical to the pin-side housing 2. Therefore the plug-side housing 5 has also a front section 50 extending along a front axis M3 and a rear section 51 extending along a rear axis M4, and wherein the front section 20 is adapted to be connected to the front section 20 of the pin-side housing 2. Furthermore the plug-side housing 5 has also the shape of a hollow cylinder defining an interior space 54 and an outer surface 52. Furthermore the plug-side housing 5 comprises also two embossments 55 which are arranged at a distance to each other. The embossments here provide also a surface on which the latching elements 53 are arranged.

In the interior space 54 the plug-side housing 5 serves to accommodate the plug-side connector 6. In case an electrical contact shall be provided between the plug-side and the pin-side, the plug-side connector 6 is adapted to establish an electrical contact with the pin-side connector 3.

The plug-side connector 6 as well as the pin-side connector 3 can be provided as unipolar connectors or as connectors having several poles.

Between the two embossments 25, 55 the housings 2, 5 comprise further a locking structure 8 with which two neighbouring housings can be locked against an axial displacement. The locking structure 8 comprises recesses 80 in the respective housing 2, 5. When the neighbouring housing are arranged at the correct position two recesses 80 provide a complete recess 82 in which a pin 83 can be introduced. Said pin 83 then prevents that two neighbouring housings 2, 5 can be axially displaced against each other. Preferably each of the elements comprises two recesses 80 so that two pins 83 have to be used to secure the housings 2, 5.

Figure 3:
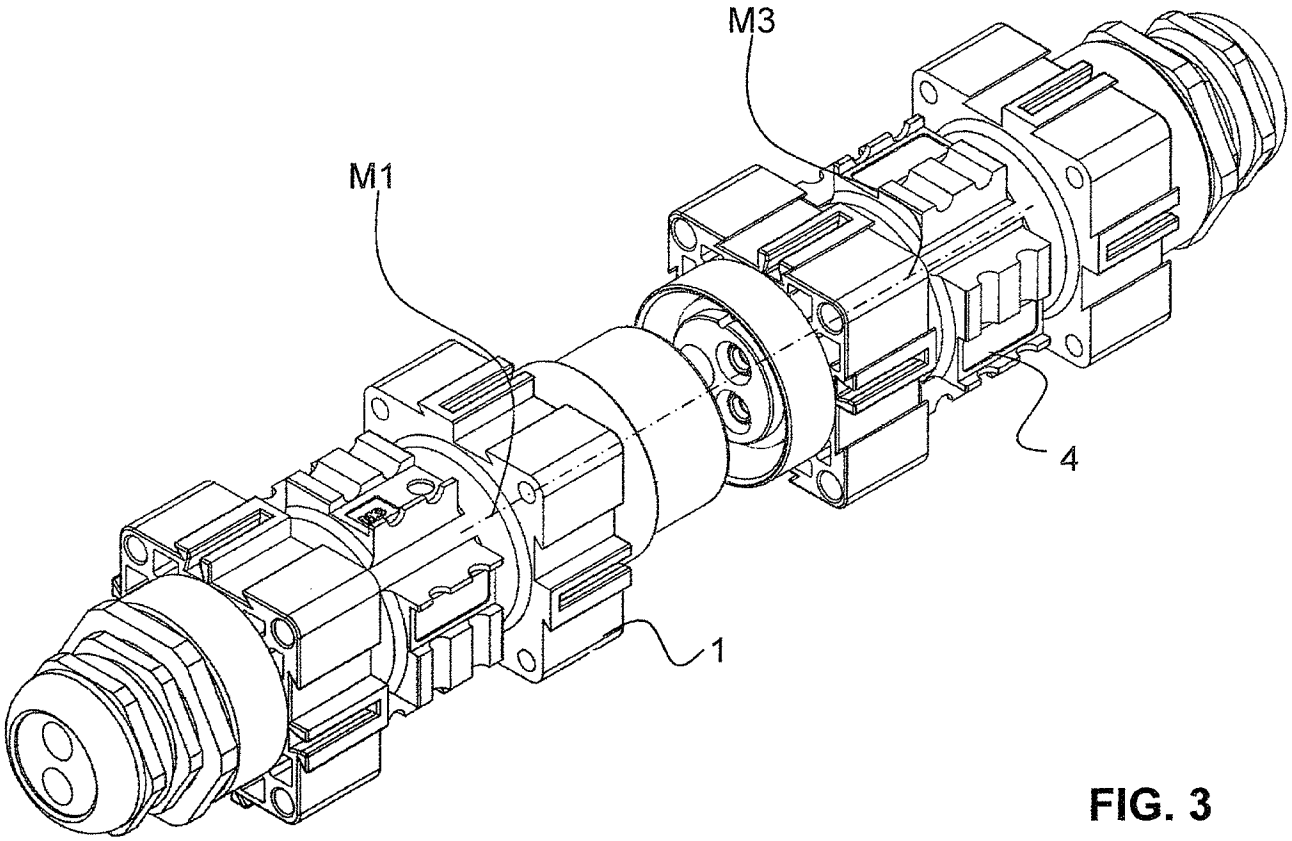
FIG. 3 shows a perspective of the pin-side of FIG. 1 and the plug-side of FIG. 2 shortly before a contact between the pin-side and the plug-side is established.

In FIG. 3 the pin-side 1 and the plug-side 4 are shown in position in which they can be connected to each other. Thereby a force along the respective axes M1 and M3 has to be applied so that the pin-side 1 and the plug-side 4 are moved towards each other.

Figure 4:
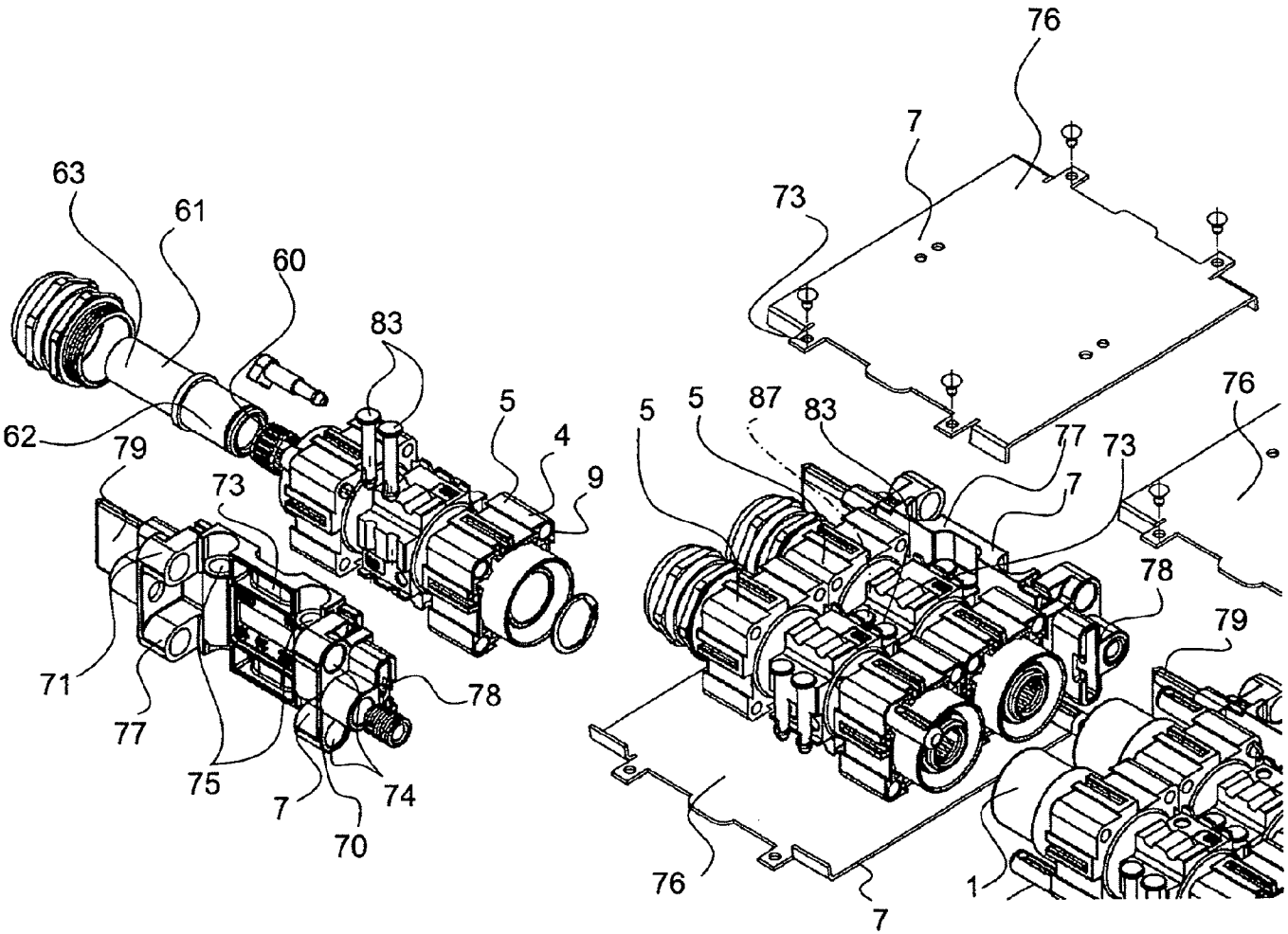
FIG. 4 shows a perspective explosion view of the plug-side of a connector assembly with shielding elements.

FIG. 4 shows an explosion view of three parallel to each other arranged plug-side housings 5 which can also be designated as contact assembly. The plug-side housing 5 to the left is shown displaced in order to enhance clarity, but it is clear that said plug housing 5 is also in connection with the other two housings in case a three-polar structure has to be provided. Furthermore a part of the pin-side 1 is also shown.

The contact assembly is encompassed by the shielding element 7 which comprises here substantially four parts. Two small shielding elements 77 are arranged to the left and the right of the contact assembly, whereas two large shielding elements 76 are arranged on the top and on the bottom of the contact assembly. All of the shielding elements 7 are in an electrical contact with each other. Preferably the shielding elements 7 are provided such that the cover substantially the respective surface of the respective housing 1, 6.

The shielding elements 7, 76, 77 comprise latching elements 73 with which the shielding element 7 can be connected to the respective housing 1, 6. In the present embodiment the shielding elements 77 which are arranged to the left and to the right are provided with latching elements 73 to be connected to the housing 1, 6, whereas the other shielding elements 7 arranged on the top and on the bottom have latching element 73 to be contacted to neighbouring shielding elements 7.

The shielding elements 77 comprise also a front section 70 and a rear section 71. The front section 70 and the rear section 71 extend in the same direction as the respective sections 20, 21; 50 51 of the pin-side housing 1 or the plug side housing 2. In order to provide an electrical contact between the shielding elements of the pin-side 1 and the shielding elements of the plug-side 4, some of the shielding elements 7, 77 comprise a plug-side 78 and a pin-side 79 in order to establish a preferably electrically connection between the plug-side 78 of the shielding element 7 and the pin-side 79 of the shielding element 7. This connection is established, when the pin-side 1 comes into contact with the plug side 2. Preferably there is a contact element, such as a contact lamella, arranged in the plug-side 78 which improves the electrical contact.

The small shielding elements 77 and the large shielding elements 76 of the shielding element 7 are in an electrical contact with each other and also with the shielding of the cable.

The shielding element 7 does not only provide an electrical shielding but also a protection against mechanical impacts on the respective housing. This is particularly advantageous, if the contact assembly is used in the field of railway technique in order to prevent that the housings will be damaged due to stone chipping etc.

The shielding element 7 comprises furthermore also coding elements 9 providing protection against reverse polarity. The coding element 9 here are coding openings 74 in which a pin may be arranged.

Furthermore the shielding element 7 may comprise clamp openings 75 via which two neighbouring shielding elements can be clamped with each other.

In FIG. 4 it is also shown that the plug-side connector 6 is provided as hollow cylinder 61 having a front side 62 in which the pin-side connector 3 is contacted and a rear side 63 in which a cable is connected to the plug-side connector 6. Furthermore the contact element 60 is shown which is arranged in the front side 63.

The contact assembly as shown in FIG. 4 can be considered as one single unit, if it is in its mounted state. This means that with the contact assembly according to FIG. 4 three polar connections can be established.

Figure 5:
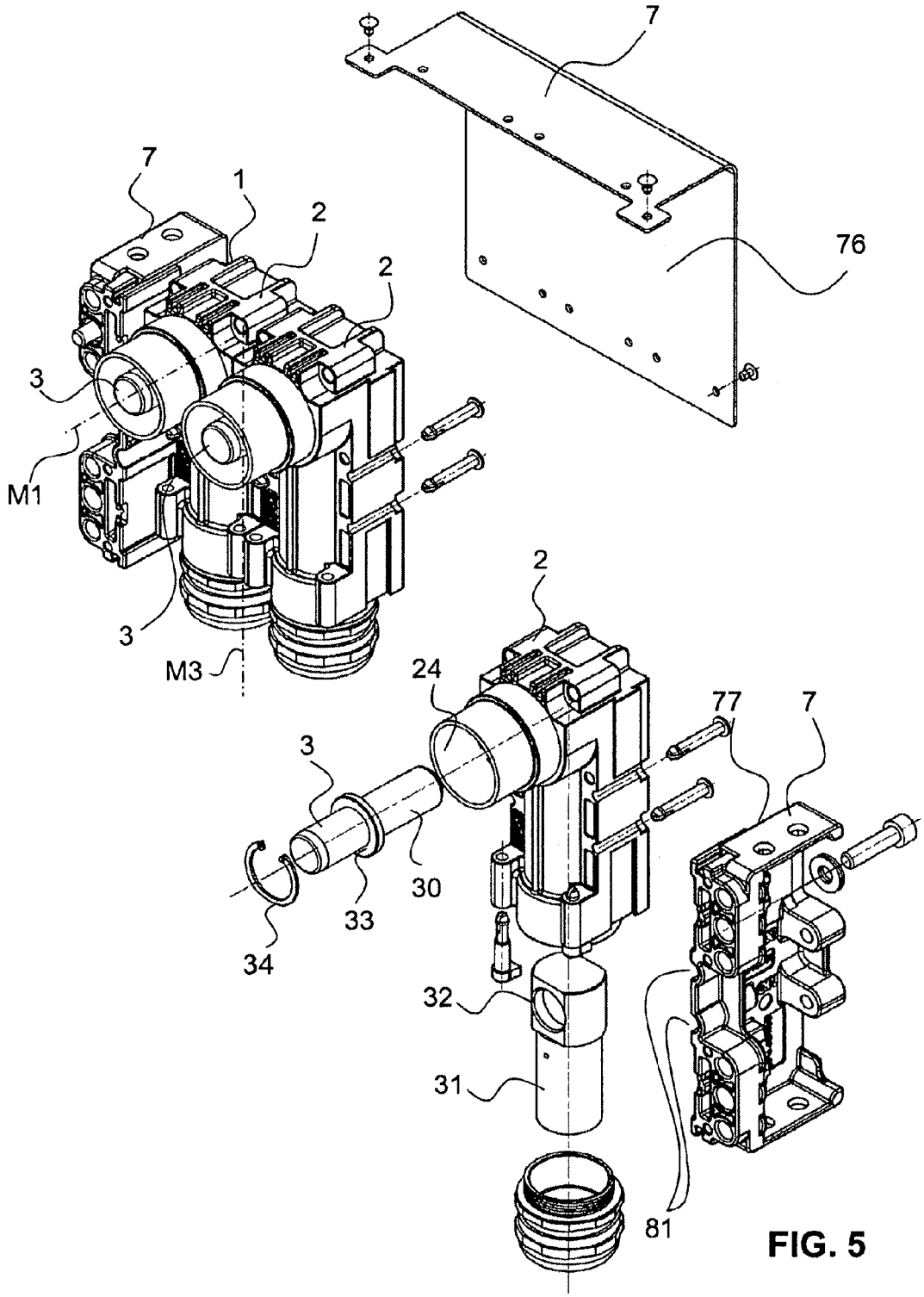
FIG. 5 shows a perspective explosion view of an angular pin-side.
Figure 6:
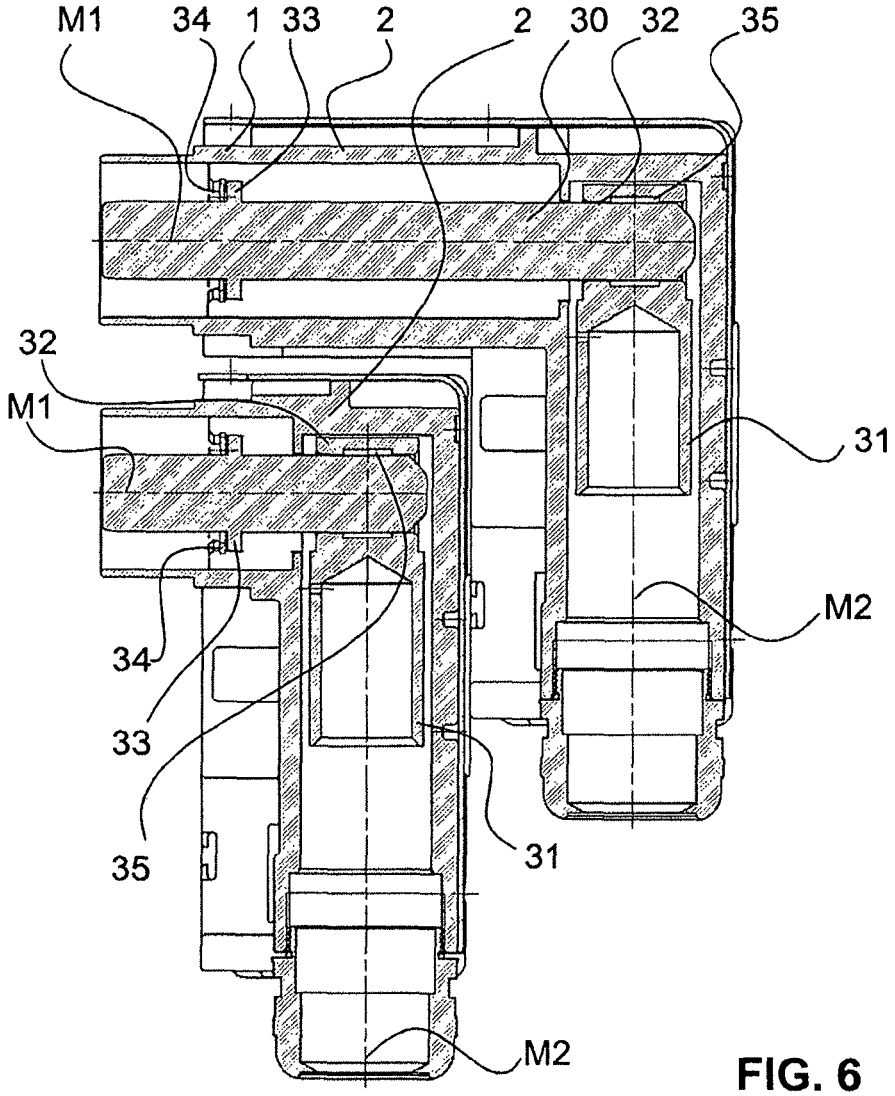
FIG. 6 shows a cross section through a connection of several angular pin-sides.
Figure 7:
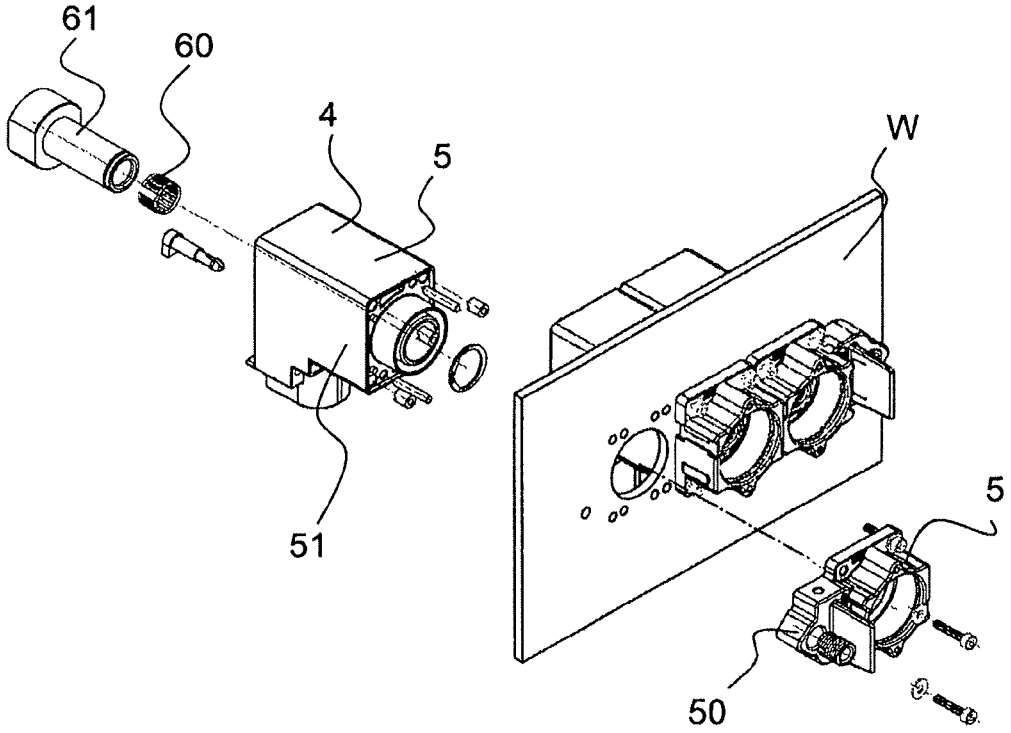
FIG. 7 shows an embodiment of a connector assembly in which one of parts are connected to a wall of a housing.

FIGS. 5 to 7 show a further embodiment of a pin-side or a plug-side, respectively. Same elements are designated with same reference numerals. One can say that the only difference between the previous embodiments and the one of FIGS. 5 to 7 is the angular arrangement. In this embodiment the front axes M1, M3 and the rear axes M2, M4 are arranged angular to each other, so that an angular plug results. The angle between the axes is here 90°, but other angles such as 135° are also possible.

In the following the structure of the pin-side connector 3 to be arranged in an angular housing is described. The structure of the plug-side connector 6 which is not shown here is identical apart from the front section which is to be contacted with the pin-side connector 3. The pin-connector 3 comprises a connector element 30 and a bridging element 31. The connector element 30 will be connected to the respective connector element of the plug-side, whereas the bridging element 31 will be in connection with a cable. The connector element 30 and the bridging element 31 are connected electrically to each other in the interior space 24 of the housing 2, namely in that region, where the front axis M1 crosses the rear axis M2. The connection between the connector element 30 and the bridging element 31 is provided by means of an opening 32 which is arranged in one of the elements 30, 31, here in the bridging element 31, wherein the other element 30, 31, here the contact element 30 extends into said opening 32. With this configuration the element with opening 32 is secured in the housing against a movement in direction of the respective axis M2. The other element is preferably secured by a circlip 34 which acts onto a shoulder 33 on the contact element 30.

Within the opening 32 there is arranged a contact element such as a contact lamella in order to provide a good electrical contact between the connector element 30 and the bridging element 31.

The structure of the connector element 30 and the bridging element 31 has the advantage that the edge connector can be provided which has marginal dimensions in direction of the front axis M1, hence a very compact edge connector can be provided.

The shielding elements 7 are also adapted to the angular shape of the housing 2. This means that the shielding element 76 has also an angular structure and that the shielding element 77 is oriented also accordingly. With this regard it has to be mentioned that the main function of the shielding element 7 is to encompass the whole housings 2, 5 in order provide an effective shielding.

In FIG. 6 there is a cross-section of the angular embodiment shown. From this embodiment one can see that also with the angular configuration a multipolar structure may be provided in a modular manner.

Furthermore it can be seen that within the opening a groove 35 is arranged in which said contact element establishing an electrical contact between the bridging element 31 and the connector element 30 can be placed.

FIG. 7 shows a possible application of the pin-side or the plug-side respectively, as described herein. In this embodiment a plug-side 4 is shown. The plug-side housing 5 is subdivided between the front section 50 and the rear section 51. The two sections 50, 51 are in contact with a wall W and extend in both directions from said wall W. This embodiment is particularly advantageous as it allows a very flexible application of the plug-side and the pin-side as described herein.

With regard to all of the embodiments it has to be mentioned here that the housings 2, 5 are made out of plastic material, preferably chosen from the group of polyethylene. The shielding elements are preferably made out of metal.

LIST OF REFERENCE SIGNS

1 pin-side
2 pin-side housing
3 pin-side connector
4 plug-side
5 plug-side housing
6 plug-side connector
7 shielding elements
8 locking structure
9 coding elements
20 front section
21 rear section

22 outer surface
23 latching elements
24 interior space
25 embossment
26 attachment surfaces
27 clamping element
30 connector element
31 bridging element
32 opening
33 shoulder
34 circlip
35 groove
50 front section
51 rear section
52 outer surface
53 latching elements
54 interior space
55 embossment
57 clamping element
60 contact element
61 hollow cylinder
62 front side
63 rear side
70 front section
71 rear section
73 latching elements
74 coding opening
75 clamp openings
76 large shielding element
77 small shielding element
78 plug-side
79 pin-side
80 recess
81 recess
82 complete recess
83 pin
M1 front axis pin-side
M2 rear axis pin-side
M3 front axis plug-side
M4 rear axis plug-side

The invention claimed is:

1. A connector assembly comprising a pin-side with at least one pin-side housing in which at least one pin-side connector is arranged, wherein said pin-side housing has a front section extending along a front axis and a rear section extending along a rear axis;

a plug-side with at least one plug-side housing in which at least one plug-side connector is arranged, wherein said plug-side housing has a front section extending along a front axis and a rear section extending along a rear axis, and wherein the front section of the pin-side is adapted to be connected with the front section of the plug-side in a direction of said front axis, and a plurality of shielding elements to provide an electromagnetic shielding, wherein said housings comprise an outer surface on which latching elements are arranged, wherein said latching elements are adapted to be received by latching elements of a neighbouring housing in order to establish a mechanical connection between two neighbouring housings, wherein said shielding elements comprise latching elements which are adapted to be received by said latching elements of said housings in order to establish a mechanical connection between the shielding element and the respective housing, wherein at least one of said shielding elements is in connection with the pin-side housing and wherein at least one of said shielding elements is in connection with the plug-side housing, and wherein said shielding elements comprise also a plug-side and a pin-side in order to establish an electrical connection between the plug-side of the shielding element and the pin-side of the shielding element.

2. The connector assembly according to claim 1, wherein said shielding element has substantially the same dimension as the housing as viewed in a direction perpendicular to said front axis and/or rear axis.

3. The connector according to claim 1, wherein said connection is an electrically connection.

4. The connector assembly according to claim 1, wherein said latching elements are oriented in direction of said front axis and/or said rear axis such that the housings are connectable with a movement in a direction of said front axis and/or said rear axis with each other or with said shielding element.

5. The connector assembly according to claim 1, wherein said housing as well as said shielding elements comprise a locking structure in order to secure neighbouring housing against a relative movement to each other and/or in order to secure said shielding elements against a relative movement to the respective housing, wherein the locking structure comprises a recess in the housing and/or a recess in the shielding element which recesses provide a complete recess, if the respective elements are in connection with each other, and a pin which can be introduced in said complete recess.

6. The connector assembly according to claim 1, wherein said housing comprises coding elements providing protection against reverse polarity, wherein said coding elements comprise openings which are arranged in said housing and coding pins which are introduceable into said openings, wherein the openings are oriented parallel to said front axis.

7. The connector assembly according to claim 1, wherein said latching elements are arranged in the front section and in the rear section so that each of the housings comprises two latching elements which are separated from each other.

8. The connector assembly according to claim 1, wherein the housings have a substantially the shape of a hollow cylinder with a substantially circular cross section, wherein said hollow cylinder defines an interior space in which said connectors are arranged, wherein the latching elements are arranged on embossments which circumvent said hollow cylinder in manner that a prismatic cross-section results, and wherein the surface of said prismatic cross-section provide said outer surface.

9. The connector assembly according to claim 1, wherein at least two groups of latching elements are arranged, whereby said two groups are arranged separately from each other at a distance and wherein between said groups said locking structure is arranged.

10. The connector assembly according to claim 1, wherein the front axis is arranged collinear with the rear axis.

11. The connector assembly according to claim 1, wherein the front axis is arranged angular with the rear axis, wherein the angle between the front axis and the rear axis is preferably between 90° or 150°, in particular 90°.

12. The connector assembly according to claim 1, wherein the pin-side connector as well as the plug-side connector comprises a connector element extending along the front axis and a bridging element extending along the rear axis, wherein either the connector element or the bridging element comprise an opening in which the bridging element or the connector element, respectively extends such that an electrical contact is established between the connector element and the bridging element.

13. The connector assembly according to claim 1, wherein the shielding element of the pin-side housing is mechanically separate from the shielding element of the plug-side housing and wherein said mechanically separate shielding elements are mechanically and electrically connectable via said plug-side of said shielding element and said pin-side of said shielding element.

* * * * *